US006885349B2

(12) United States Patent
Hickel

(10) Patent No.: US 6,885,349 B2
(45) Date of Patent: Apr. 26, 2005

(54) VEHICLE ANTENNA SYSTEM

(75) Inventor: Frank Hickel, Hagenburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/276,756

(22) PCT Filed: May 3, 2001

(86) PCT No.: PCT/DE01/01678

§ 371 (c)(1),
(2), (4) Date: Jul. 10, 2003

(87) PCT Pub. No.: WO01/89032

PCT Pub. Date: Nov. 22, 2001

(65) Prior Publication Data

US 2004/0021610 A1 Feb. 5, 2004

(30) Foreign Application Priority Data

May 18, 2000 (DE) ..... 100 24 666

(51) Int. Cl.[7] ..... H01Q 1/32
(52) U.S. Cl. ..... 343/713; 343/721; 343/711
(58) Field of Search ..... 343/713, 711, 343/712, 721, 720, 729, 730, 725, 726, 803; H01Q 1/32

(56) References Cited

U.S. PATENT DOCUMENTS

| | | | | |
|---|---|---|---|---|
| 3,683,379 A | * | 8/1972 | Saddler et al. | 342/71 |
| 5,446,470 A | * | 8/1995 | Avignon et al. | 343/713 |
| 5,682,168 A | | 10/1997 | James et al. | |
| 5,963,172 A | * | 10/1999 | Pfizenmaier et al. | 343/721 |
| 6,067,447 A | * | 5/2000 | Zucker | 455/69 |

FOREIGN PATENT DOCUMENTS

| | | |
|---|---|---|
| DE | 196 36 584 | 3/1998 |
| DE | 197 30 173 | 1/1999 |
| EP | 0 343 322 | 11/1989 |
| EP | 0 590 955 | 4/1994 |
| EP | 0 821 429 | 7/1997 |
| FR | 2 691 581 | 11/1993 |
| WO | WO 99 63617 | 12/1999 |

* cited by examiner

*Primary Examiner*—Hoanganh Le
(74) *Attorney, Agent, or Firm*—Kenyon & Kenyon

(57) ABSTRACT

A vehicle antenna array including at least one antenna element integrated into a body of the vehicle, is disclosed, which array nevertheless permits easy accessibility of the antenna element. The at least one antenna element is integrated into a lighting device of the vehicle.

9 Claims, 6 Drawing Sheets

VEHICLE ANTENNA SYSTEM

FIELD OF THE INVENTION

The present invention is directed to a vehicle antenna array.

BACKGROUND INFORMATION

The various wireless services that are currently receivable in a vehicle include radio, mobile wireless telephone, global positioning signals, CB radio, etc. Each of these wireless services requires an antenna optimized specifically for the particular frequency range. If several of these wireless services are required in one motor vehicle, the number of antennas required on the vehicle increases.

There have been various attempts to reduce the number of antennas required on a vehicle by using multi-band antennas, which may be operated in various frequency ranges. Then different wireless services are received over a single antenna.

In addition, it is conventional that antenna elements or a multi-band antenna may be integrated into the body of the vehicle.

Such a multi-band antenna may be integrated into the body of the vehicle as a disk antenna, for example, and may be provided for reception of AM radio, FM radio, and mobile wireless telephone, e.g., according to the GSM standard (Global System for Mobile Communications), as described in German Published Patent Document No. 297 16 979.

With such disk antennas, however, there is the problem that they are located within the visibility range of the driver and/or front passenger of the vehicle, and a large portion of the power they deliver is delivered into the interior of the vehicle due to the configuration. Another problem is that vehicle windows today are constructed with a metallized layer. However, this layer interferes with the directional diagrams of such disk antennas.

It is also conventional that antenna elements may be integrated into the interior mirror of a vehicle, as discussed in European Patent Application No. 0 821 429, for example. It is discussed in U.S. Pat. No. 5,682,168 that antenna elements may be integrated into the A-pillar or into braces of the vehicle. It is discussed in German Published Patent Application No. 197 30 173 that antenna elements may be integrated into the fender, doors, and roofs of the vehicle. In addition, it is discussed in German Patent No. 196 36 584 that antenna structures may be integrated into the bumpers of vehicles.

SUMMARY OF THE INVENTION

The vehicle antenna array according to the present invention may provide that at least one antenna element is integrated into a lighting device in the vehicle. In this manner, the receptacles for the lighting devices provided in the body of the vehicle may additionally be used to accommodate at least one antenna element, so that their functionality is increased. The at least one antenna element in the arrangement in a lighting device in the vehicle is still readily accessible despite the integration into the body of the vehicle achieved in this manner, because any cover on the lighting device, i.e., in the form of a headlight glass, must be removable for replacing the luminescent material or the light fixture of the lighting device. In this manner, a defective antenna element or one that has made poor contact is easily replaced, because only the cover of the lighting device need be removed to obtain access to the antenna element.

Installation of the at least one antenna element may be accomplished with especially little effort together with the installation of the lighting device, so that a separate operation is not necessary for installation of the at least one antenna element on the vehicle body.

If antenna elements for different wireless services such as radio, mobile wireless telephone, reception of GPS signals, etc. are integrated into one or more lighting devices of the vehicle, then no additional antenna element is necessary on the motor vehicle or its body.

In the case of integration into a lighting device, the at least one antenna element may be integrated into the body of the vehicle in an especially inconspicuous manner.

The at least one antenna element may be arranged behind a headlight glass of the lighting device. In this manner, the at least one antenna element is protected from weather effects and also from vandalism, because there are no projecting structures which stand out on the body of the vehicle.

The headlight glass may carry the at least one antenna element. In this manner, the functionality of the headlight glass may be increased, and it is possible to eliminate a separate carrier material for the at least one antenna element.

In addition to the at least one antenna element, an antenna amplifier may be integrated into the lighting device. In this manner, the functionality of the lighting device may be further increased in that it is additionally used to accommodate the antenna amplifier. The antenna amplifier is then protected from weather effects and vandalism when mounted accordingly behind the headlight glass, as is the at least one antenna element. The antenna amplifier is also just as accessible as the at least one antenna element by removing the cover on the lighting device, and thus it may be replaced easily if it is defective or faulty.

Due to the integration of the antenna amplifier into the lighting device, a separate installation step for installation of the antenna amplifier is unnecessary.

A first antenna element may be configured as a folded dipole antenna, which surrounds a light fixture of the lighting device at least partially. In this manner, the luminous effect of the lighting device is not impaired by the first antenna element.

Exemplary embodiments of the present invention are illustrated in the drawings and explained in the following description.

BRIEF DESCRIPTION OF THE DRAWINGS

FIG. 3(*b*) shows a side view of the rear window of the vehicle.

FIG. 3(*c*) shows a top view of a brake light in the rear window of the vehicle.

FIG. 3(*d*) shows a side view of the brake light.

FIG. 4(*b*) shows a second example of an antenna array in a front headlight.

FIG. 4(*c*) shows a third example of an antenna array in a front headlight.

FIG. 5(*b*) shows a second example of an antenna array in a rear light.

FIG. 5(*c*) shows a third example of an antenna array in a rear light.

DETAILED DESCRIPTION

Figure 1:
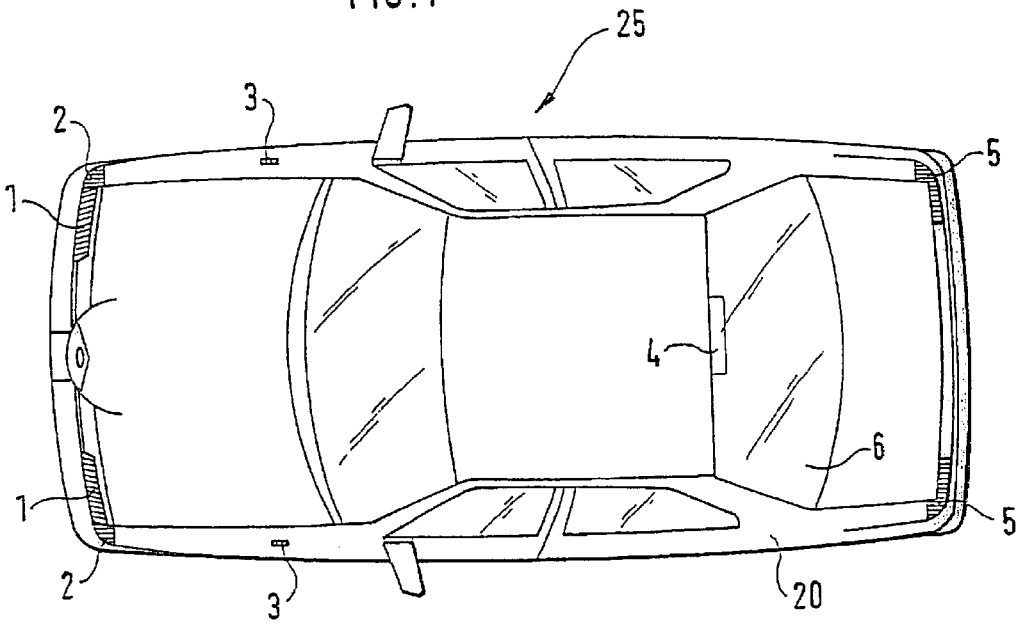
FIG. 1 shows a top view of a motor vehicle.

FIG. 1 shows a top view of a vehicle 25 configured as a motor vehicle. It includes a vehicle body 20 on which are mounted in the usual positions lighting devices in the form of front headlights 1, turn indicators 2, additional turn indicators 3 arranged on the side and rear lights 5. In addition, an additional brake light fixture 4 may be provided in the area of a rear window 6 on motor vehicle 25 according to FIG. 1.

Figure 2:
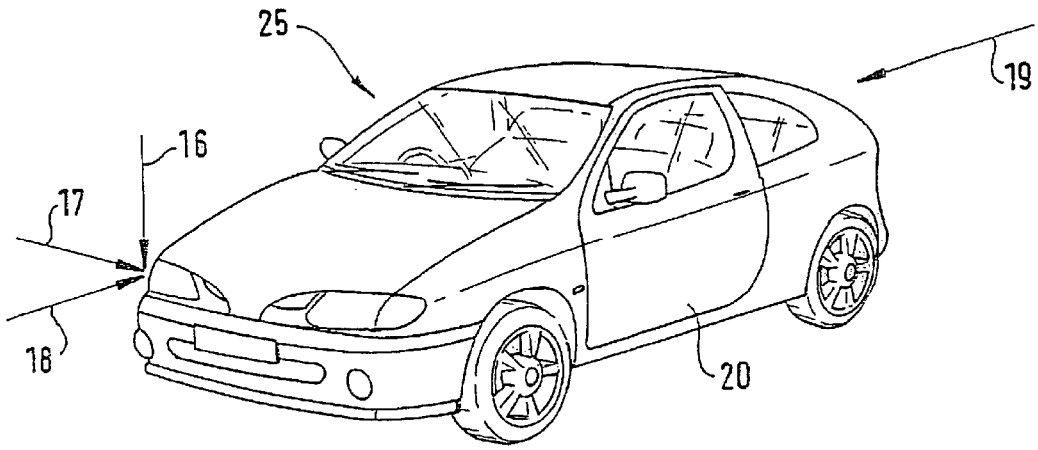
FIG. 2 shows a diagram for defining various views of the vehicle.
Figure 3A:
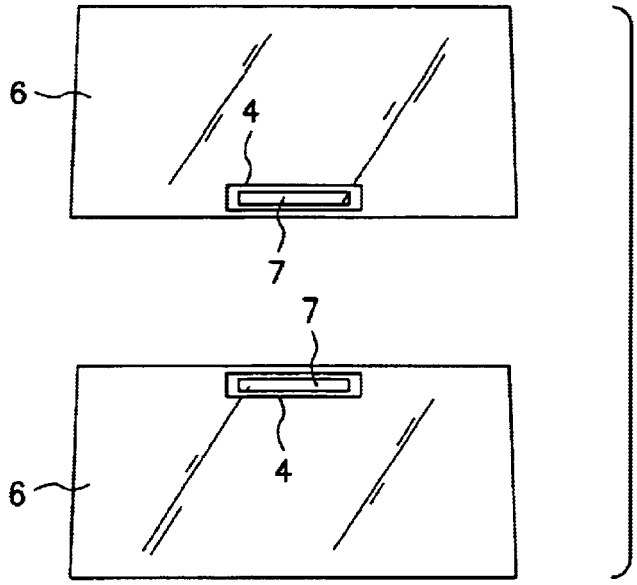
FIG. 3(*a*) shows a top view of a rear window of a vehicle.
Figure 3B:
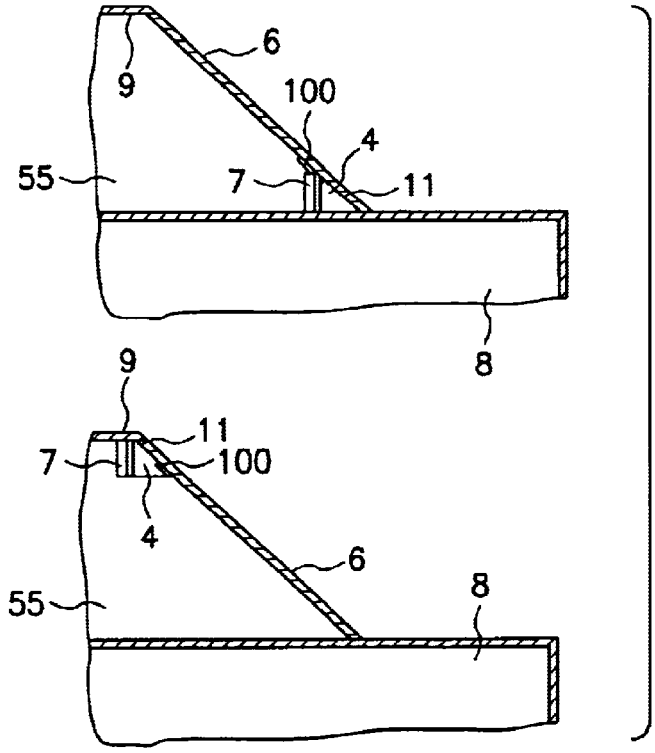
Figure 3C:
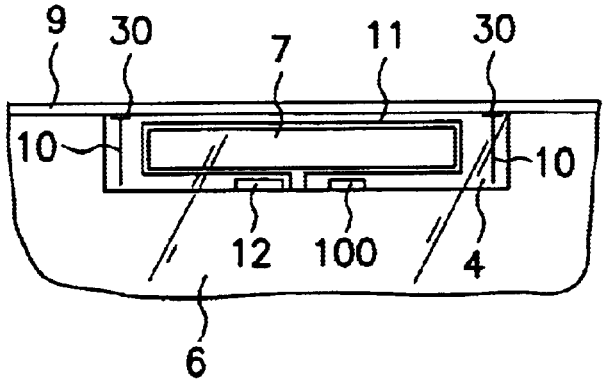
Figure 3D:
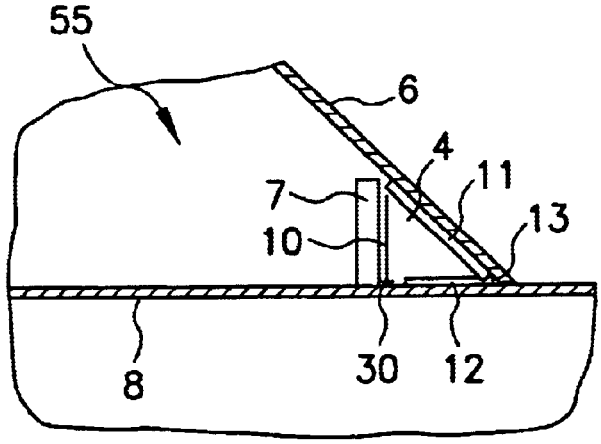

FIG. 2 shows vehicle 25 including vehicle body 20 in a diagonal view to define various views for the following figures. Reference number 16 defines a top view of motor vehicle 25. Reference number 17 defines a side view of motor vehicle 25. Reference number 18 defines a front view of motor vehicle 25. Reference number 19 defines a rear view of motor vehicle 25.

FIG. 3(*a*) shows rear window 6 of motor vehicle 25. According to FIG. 3(*a*), an additional brake light fixture 4 is arranged on the lower longitudinal edge or on the upper longitudinal edge of rear window 6. Additional brake light fixture 4 includes a brake light 7. In FIG. 3(*b*), rear window 6 is shown with brake light fixture 4 in side view 17, showing that rear window 6 is arranged between a vehicle roof 9 and a vehicle luggage compartment 8 in vehicle body 20, rear window 6 closing off a passenger compartment 55 of vehicle 25 at an obtuse angle to vehicle roof 9 and at an acute angle to vehicle luggage compartment 8. When arranged on the lower longitudinal edge of rear window 6, additional brake light fixture 4 is in the form of a wedge inserted into the acute angle formed by rear window 6 and vehicle luggage compartment 8. In the arrangement of additional brake light fixture 4 on the upper longitudinal edge of rear window 6, additional brake light fixture 4 is also inserted in a wedge form into the obtuse angle between rear window 6 and vehicle roof 9.

FIG. 3(*c*) shows in detail additional brake light fixture 4 in the arrangement on the upper longitudinal edge of rear window 6 in rear view 19 of motor vehicle 25. This shows that additional brake light fixture 4 includes brake light 7, which is visible in rear view 19. According to the example in FIG. 3(*c*), additional brake light fixture 4 also includes a first antenna element 11 in the form of a folded dipole antenna, which almost completely surrounds brake light 7. Brake light 7 is thus not covered by folded dipole antenna 11 and thus its lighting effect is not impaired. Additionally or alternatively, additional brake light fixture 4 according to FIG. 3(*c*) may include a second antenna element in the form of a monopole whose base point 30 is connected to vehicle roof 9 as an electrically conductive surface and as part of vehicle body 2D. FIG. 3(*c*) shows that two such monopoles 10 may also be provided on the right and left of brake light 7, each connected to vehicle roof 9 by its base point 30. Additionally or as an alternative to the antenna elements described above, additional brake light fixture 4 may also include a third antenna element 12 in the form of a patch antenna beneath brake light 7. Such a patch antenna may be provided for receiving GPS signals (Global Positioning System).

According to FIG. 3(*d*), additional brake light fixture 4 is shown in detail in side view 17 with the arrangement on the lower longitudinal edge of rear window 6. This shows that additional brake light fixture 4 includes a headlight glass 13 which is in contact with rear window 6 in passenger compartment 55. Headlight glass 13 has approximately the same inclination as rear window 6, so that headlight glass 13 and rear window 6 are in contact over the entire surface in the ideal case according to FIG. 3(*d*). Headlight glass 13 carries folded dipole antenna 11. This is also the case with the arrangement of additional brake light fixture 4 on the upper longitudinal edge of rear window 6, as shown in FIG. 3 (b), for example. In both cases, as described here, it is possible to provide for folded dipole antenna 11 to surround brake light 7, as illustrated in FIG. 3(*c*). Additional brake light fixture 4 illustrated in FIG. 3(*d*) on the lower longitudinal edge of rear window 6 also includes a monopole 10, but its base point 30 sits on vehicle luggage compartment 8 as an electrically conducting surface and as part of vehicle body 20 and thus is connected to it. In addition, according to the example in FIG. 3(*d*), a patch antenna 12 is also in contact with vehicle luggage compartment B. Patch antenna 12 is arranged between brake light 7 and headlight glass 13.

Figure 4A:
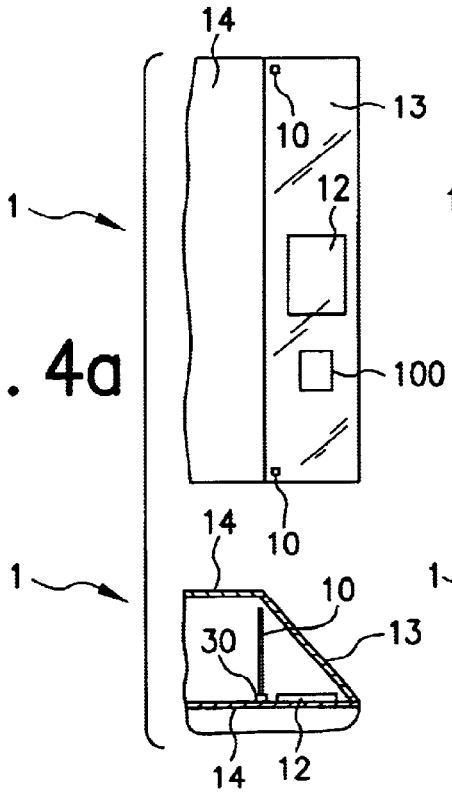
FIG. 4(*a*) shows a first example of an antenna array in a front headlight.
Figure 4B:
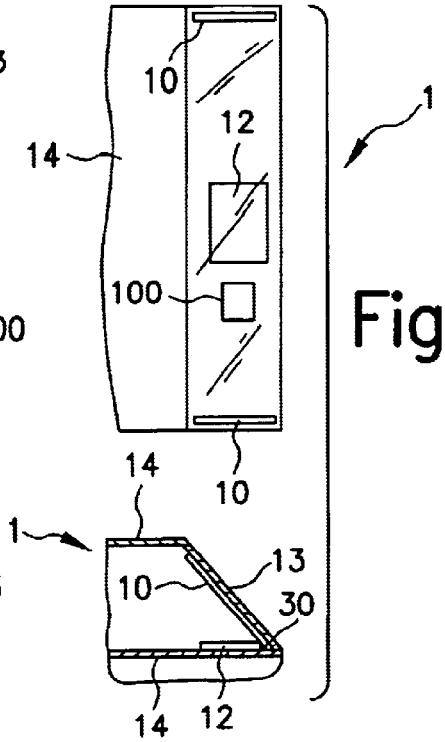
Figure 4C:
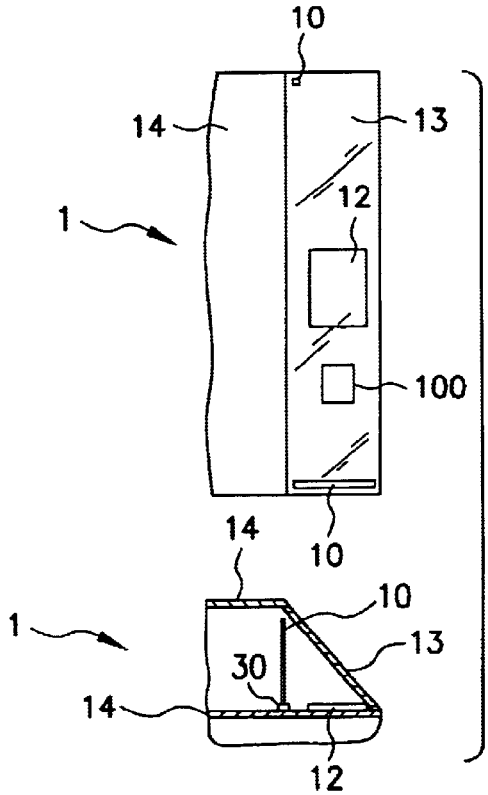

FIG. 4 shows three different exemplary embodiments of the arrangement of antenna elements in at least one of the two front headlights 1. Each of these three exemplary embodiments are illustrated by top view 16 and side view 17 in FIG. 4.

According to FIG. 4(*a*), front headlight 1 in side view 17 again shows a beveled headlight glass 13. Front headlight 1 is bordered at the top and bottom by a vehicle engine hood 14 as part of body 20 of motor vehicle 25. According to top view 16 in FIG. 4(*a*), front headlight 1 again includes two monopoles 10, which are perpendicular to engine hood 14 and are electrically connected at their base point 30 to the part of vehicle engine hood 14, as an electrically conducting surface, bordering front headlight 1 at the bottom, as indicated by side view 17 according to FIG. 4(*a*). Front headlight 1 also includes a patch antenna 12, which according to top view 16 is arranged approximately in the center of front headlight 1 and rests on the part of vehicle engine hood 14 bordering front headlight 1 at the bottom according to side, view 17 in FIG. 4(*a*). The exemplary embodiments according to FIGS. 4(*b*) and 4(*c*) correspond to the exemplary embodiment according to FIG. 4(*a*) with regard to the arrangement of patch antenna 12 in front headlight 1. In the exemplary embodiment according to FIG. 4(*b*), monopoles 10 are no'longer perpendicular to vehicle engine hood 14 but instead are carried by headlight glass 13 which is bent at an angle with respect to vehicle engine hood 14. Monopoles 10 are also connected at their base point 30 to the part of vehicle engine hood 14 which borders front headlight 1 at the bottom according to side view 17 in FIG. 4(*b*).

The exemplary embodiment according to FIG. 4(*c*) shows a mixed form in which one of two monopoles 10, as in the exemplary embodiment according to FIG. 4(*a*), is perpendicular to vehicle engine hood 14 and the other of the two monopoles 10, as in the exemplary embodiment according to FIG. 4(*b*), is carried by headlight glass 13.

Figure 5A:
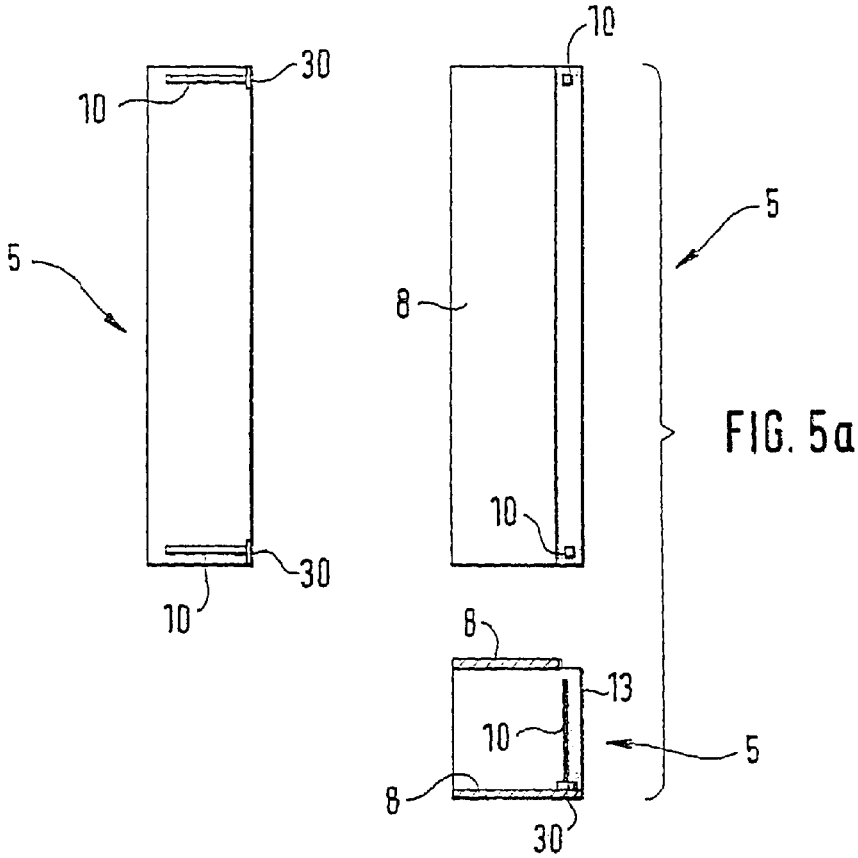
FIG. 5(*a*) shows a first example of an antenna array in a rear light.
Figure 5B:
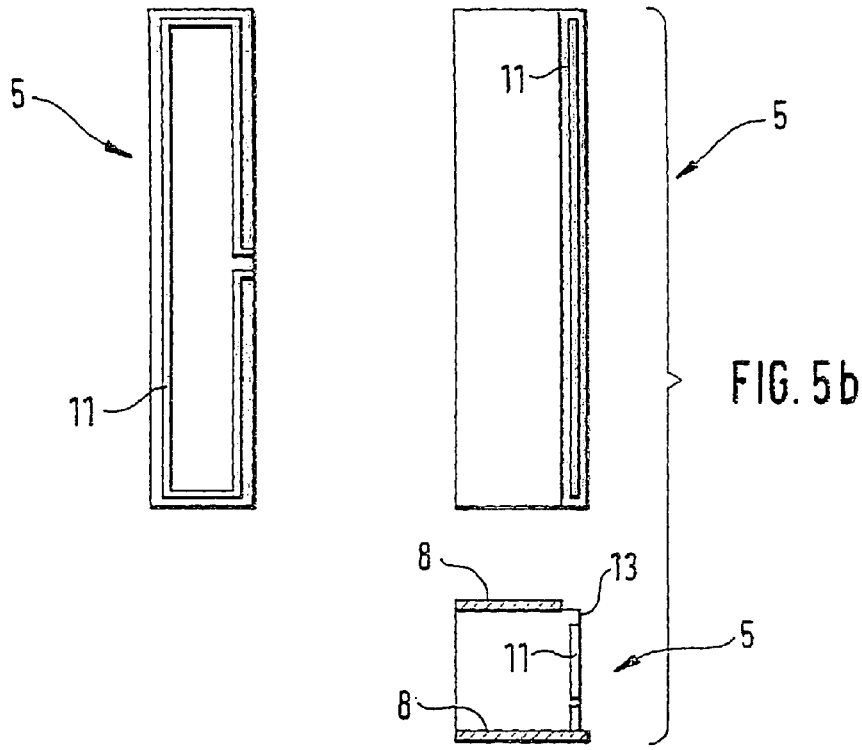
Figure 5C:
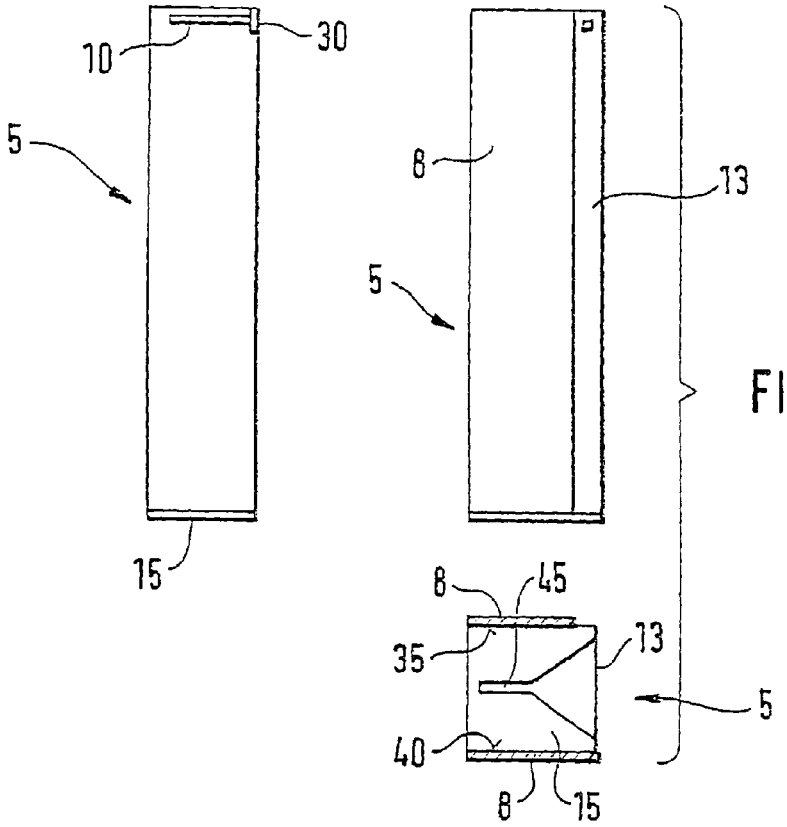

FIG. 5 shows three exemplary embodiments of an antenna array in one of rear lights 5 according to FIG. 1. In each of these three exemplary embodiments, corresponding rear light 5 is shown in rear view 19, top view 16, and side view 17. In the exemplary embodiment according to FIG. 5(*a*), rear light 5 in turn encloses two monopoles 10, which are perpendicular to vehicle luggage compartment 8 as an electrically conducting surface of vehicle body 20. Rear light 5 is bordered at the top and bottom by vehicle luggage compartment 8. Monopoles 10 are electrically connected at their base point 30 to the part of vehicle luggage compartment 8 which borders rear light 5 at the bottom.

In all the exemplary embodiments described here, monopoles 10 are arranged at the right and left of the lighting arrangement of corresponding lighting devices 1, 2, 3, 4, 5 of motor vehicle 25, so that they do not cover the lighting arrangement and do not impair its lighting effect. The same thing is also true of patch antennas 12 described above.

In the exemplary embodiment according to FIG. 5(*b*), rear light 5 includes a folded dipole antenna 11 instead of monopole 10, the dipole is carried by headlight glass 13 of rear light 5 so that it surrounds the lighting arrangement of rear light 5 so that the lighting arrangement of rear light 5 is not covered by folded dipole antenna 11 and its lighting effect is not impaired. The lighting arrangements are not shown in the exemplary embodiments according to FIGS. 4, 5, and 6 for the sake of simplicity. The lighting arrangement in the exemplary embodiment according to FIG. 5(*b*) may be surrounded in the manner illustrated in FIG. 3(*c*).

In another exemplary embodiment according to FIG. 5(*c*), rear light 5 includes a single monopole 10 which is arranged perpendicular to the vehicle luggage compartment 8, as in the exemplary embodiment according to FIG. 5(*a*), and is connected at its base point 30 to the part of vehicle luggage compartment 8 which borders rear light 5 at the bottom. Instead of second monopole 10, rear light 5 in the exemplary embodiment according to FIG. 5(*c*) includes a fourth antenna element-15, which is configured as a notch antenna element, the notch antenna element 15 being electrically connected to vehicle luggage compartment 8 on two opposite edges 35, 40 which run in approximately the same direction or in a direction parallel to a notch 45 of notch antenna element 15. Notch antenna element 15 is also arranged in rear light 5 in such a manner that both notch 45 and the two opposite edges 35, 40 of notch antenna element 15 run approximately parallel to the cut edges of vehicle luggage compartment 8 in the side view according to FIG. 5(*c*). Notch antenna element 15 is arranged in rear light 5 so that it does not cover the lighting arrangement of rear light 5 and thus does not interfere with its lighting effect.

Figure 6:
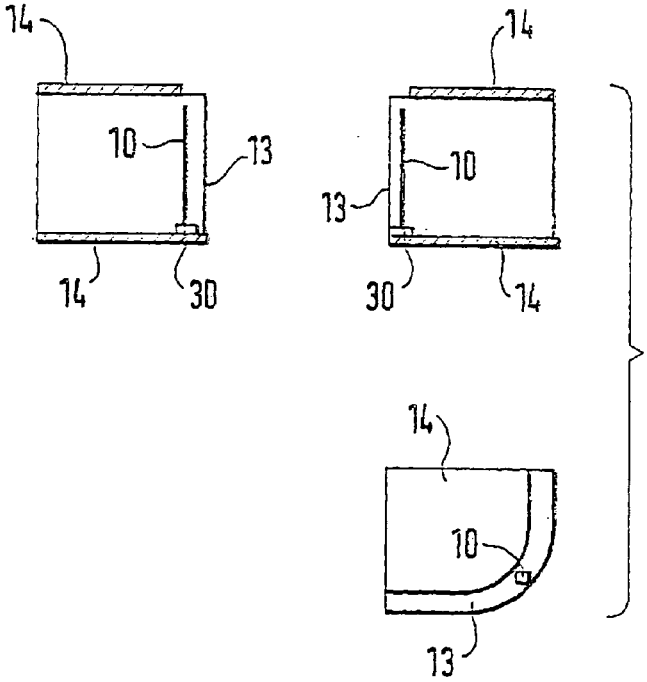
FIG. 6 shows an antenna array in a turn indicator.

Another exemplary embodiment according to FIG. 6 illustrates an antenna array which is integrated into one of the two turn indicators 2 according to FIG. 1. As in the exemplary embodiments according to FIG. 4 for front headlight 1, turn indicator 2 is bordered at the top and bottom by vehicle engine hood 14. According to FIG. 6, turn indicator 2 includes a monopole 10, which is perpendicular to vehicle engine hood 14 and whose base point 30 is connected to the part of vehicle engine hood 14 which borders turn indicator 2 at the bottom. Turn indicator 2 is shown in FIG. 6 in both side view 17 and front view 18 as well as top view 16. It is bordered at the outside by a headlight glass 13.

In all the exemplary embodiments described here, antenna elements 10, 11, 12, 15 are arranged behind headlight glass 13 of corresponding lighting device 1, 2, 4, 5. In this manner, they are protected from weather effects and vandalism.

In addition, it is possible for one or more antenna elements 10, 11, 12, 15 arranged in one of lighting devices 1, 2, 3, 4, 5 to be provided with an antenna amplifier (e.g., element 100 of FIGS. 3*b–d* and 4*a–c*), which is integrated into lighting device 1, 2, 3, 4, 5 together with associated antenna element 10, 11, 12, 15. Power may be supplied to such an antenna amplifier through the onboard power supply of motor vehicle 25, and an additional power supply line to the corresponding lighting device could be installed at the time of manufacture of motor vehicle 25 to prevent the need for retrofitting such a power supply line and the associated expense. Higher sensitivities for the signals received by the antenna element may be achieved due to the antenna amplifier integrated into the lighting device with the associated antenna element. The antenna elements integrated into lighting devices 1, 2, 3, 4, 5 of motor vehicle 25 are adequately shielded by vehicle body 20 so that no electromagnetic fields are directed into passenger compartment 55. Therefore, no radiation caused by the antenna elements is measured in passenger compartment 55 when performing a test of EMC (electromagnetic compatibility).

One or more antenna elements may also be integrated into additional turn indicator 3 in the manner described for front headlight 1, turn indicator 2, additional brake light 4, and rear light 5.

The arrangement of individual antenna elements in various lighting devices 1, 2, 3, 4, 5 of motor vehicle 25 as described here is given purely as an example. Any desired combinations of antenna elements in lighting devices 1, 2, 3, 4, 5 of motor vehicle 25 are also conceivable. One or more antenna elements 10, 11, 12, 15 may also be provided in each lighting device 1, 2, 3, 4, 5. The antenna elements may be configured for sending and/or receiving wireless signals in one or more frequency ranges. Patch antenna 12 may be used for receiving GPS signals. The notch antenna is a very broadband antenna structure with which it is possible to combine, for example, the E network (1.8 GHz), the UMTS network (1.7–2.2 GHz), and DAB reception. Otherwise, the antenna elements may be used for receiving radio broadcast signals in various frequency bands, for sending and/or receiving mobile wireless signals, for sending and/or receiving CB radio signals, etc. For radio, signals in the AM and FM bands may be received. For mobile wireless, for example, the frequency ranges of GSM (Global System for Mobile Communications) or UMTS (Universal Mobile Telecommunication System) may be used. For mobile wireless, for example, it is also possible to use frequency ranges of the C network, the D network, or the E network.

What is claimed is:

1. A vehicle antenna array for a vehicle, comprising:

at least one antenna element integrated into a lighting device of the vehicle, wherein the at least one antenna element is configured as a folded dipole antenna that at least partially surrounds a light fixture of the lighting device; and an antenna amplifier integrated into the lighting device;

a second antenna element configured as a monopole, a base point of the monopole being connected to an electrically conducting planar body.

2. The vehicle antenna array of claim 1, wherein the at least one antenna element is arranged in one of a brake light fixture, a front headlight, a turn indicator, and a rear light.

3. The vehicle antenna array of claim 1, wherein the at least one antenna element is arranged behind a glass of the lighting device.

4. The vehicle antenna array of claim 3, wherein the glass carries the at least one antenna element.

5. The vehicle antenna array of claim 1, wherein the electrically conducting planar body is a body of the vehicle.

6. The vehicle antenna array of claim 1, further comprising a third antenna element configured as a patch antenna arranged on the electrically conducting planar body.

7. The vehicle antenna array of claim 6, wherein the patch antenna is a Global Positioning System (GPS) patch antenna, and wherein the electrically conducting planar body is a body of the vehicle.

8. The vehicle antenna array of claim 6, further comprising a fourth antenna element configured as a notch antenna element connected to the electrically conducting planar body at two opposite edges of the planar body extending approximately in a same direction as a notch antenna element.

9. The vehicle antenna array of claim 8, wherein the electrically conducting planar body is a body of the vehicle.

* * * * *